United States Patent [19]

Tanaka

[11] 4,102,122

[45] Jul. 25, 1978

[54] ELECTRONIC WATCH

[75] Inventor: Kojiro Tanaka, Tokyo, Japan

[73] Assignee: Kabushiki Kaisha Daini Seikosha, Japan

[21] Appl. No.: 738,875

[22] Filed: Nov. 4, 1976

[30] Foreign Application Priority Data

Nov. 4, 1975 [JP] Japan ..... 50/132345

[51] Int. Cl.[2] ..... G04B 19/24

[52] U.S. Cl. ..... 58/58; 58/4 A

[58] Field of Search ..... 58/4 A, 58

[56] References Cited

U.S. PATENT DOCUMENTS

| | | | |
|---|---|---|---|
| 3,788,058 | 1/1974 | Idei et al. | 58/50 R |
| 3,797,222 | 3/1974 | Kato | 58/4 A |
| 3,852,950 | 12/1974 | Yoda | 58/58 |
| 3,961,472 | 7/1974 | Riehl | 58/50 R |

*Primary Examiner*—Edith S. Jackmon

*Attorney, Agent, or Firm*—Robert E. Burns; Emmanuel J. Lobato; Bruce L. Adams

[57] ABSTRACT

An electronic watch including a time counter, a day counter and a month counter for developing counts respectively representing time of the day, day of the month, and the month. The day counter is responsive to a control signal for limiting a maximum count of the day counter to 28, 29, 30 or 31 days. A control signal circuit develops the control signal and applied the same to the day counter for limiting the maximum count of the day counter to 31 days during a long month, 30 days during a short month, and 28 or 29 days during February. The watch further includes a display responsive to the respective counts of the various counters for displaying time of the day, day of the month, and the month.

4 Claims, 5 Drawing Figures

FIG. 4

| counting number | displayed date | $Q_e$ | $Q_d$ | $Q_c$ | $Q_b$ | $Q_a$ |
|---|---|---|---|---|---|---|
| 0 | 1 | 0 | 0 | 0 | 0 | 1 |
| 1 | 2 | 0 | 0 | 0 | 0 | 0 |
| 2 | 3 | 0 | 0 | 0 | 1 | 1 |
| ⋮ | ⋮ | ⋮ | ⋮ | ⋮ | ⋮ | ⋮ |
| 26 | 27 | 1 | 1 | 0 | 1 | 1 |
| 27 | 28 | 1 | 1 | 1 | 0 | 0 |
| 28 | 29 | 1 | 1 | 1 | 0 | 1 |
| 29 | 30 | 1 | 1 | 1 | 1 | 0 |
| 30 | 31 | 1 | 1 | 1 | 1 | 1 |
| 31 | | 0 | 0 | 0 | 0 | 0 |

FIG. 5

| counting number | displayed month | $Q_d$ | $Q_c$ | $Q_b$ | $Q_a$ |
|---|---|---|---|---|---|
| 0 | 1 | 0 | 0 | 0 | 1 |
| 1 | 2 | 0 | 0 | 1 | 0 |
| 2 | 3 | 0 | 0 | 1 | 1 |
| 3 | 4 | 0 | 1 | 0 | 0 |
| 4 | 5 | 0 | 1 | 0 | 1 |
| 5 | 6 | 0 | 1 | 1 | 0 |
| 6 | 7 | 0 | 1 | 1 | 1 |
| 7 | 8 | 1 | 0 | 0 | 0 |
| 8 | 9 | 1 | 0 | 0 | 1 |
| 9 | 10 | 1 | 0 | 1 | 0 |
| 10 | 11 | 1 | 0 | 1 | 1 |
| 11 | 12 | 1 | 1 | 0 | 0 |

ELECTRONIC WATCH

DETAILED EXPLANATION OF INVENTION

This invention relates to an electronic watch equipped with a calender function to display date, month and as well as time.

Some of the electronic watches are not equipped with the calender function and the other are equipped. The former electronic watches, except for these having no calender function, have its constitution to function to count the day till 31st day at every month and display the date of the particular day.

Therefore, when we have the days of first of March, May, July, October and December, the watches show 31st day of the last month (in February, 29th day or 30th day) in the display portion, so the user has to change the display of date on all such occasions. Some of the electronic watches having the calender function are equipped with the perpetual calender function displaying automatically 31st day at every longer month, 30th day at every shorter month except February and also 29th day at February when that year is a leap year or 28th day when that year is not a leap year.

According to the conventional watch explained above, a year counter and the indication segment for displaying years are by all means necessary, so that the logical circuit of IC making up a watch circuit is made complicated and also the display device is made complicated, resulting in the rise of the price.

BRIEF DESCRIPTION OF DRAWINGS

FIG. 4 is the truth table of output of the date counter shown in FIGS. 2 and 3, and FIG. 5 is the drawing showing the truth table of output of the date counter shown in FIGS. 2 and 3.

2—display apparatus
3—minute display portion
4—hour display portion
5—month display portion
10—time counter
13—date counter
14—month counter
22—the ring counter
27—the date control circuit
Sa—reset switch
Sb—select switch
Sc—correct switch According to the present invention, the date counter, which is ordinarily set 28th day of the circulating cycle at February can be set 29th day of February in a leap year by a simple switching operation. And it is no need of special external switching mechanism to do said operation, accordingly constitution of the watch is made so simple as to produce the watch at a moderate price or economically. Thus, the shortcomings relating to said conventional electronic watches having the perpetual calender function are dissolved. We propose electronic watches having novel calender function. The present invention will be explained in detail on the basis of the embodiments shown.

Figure 1:
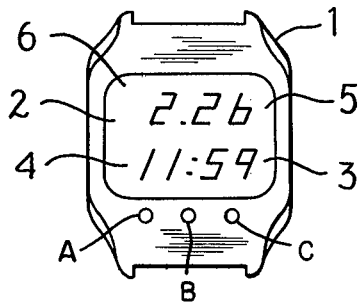
FIG. 1 is external view of an embodiment of the electronic watch according to the invention.

In FIG. 1 showing an embodiment of the electronic watch according to this invention, a reference numeral shows a watch case, wherein a cell (not shown) of the electronic power source, a watch circuit (not shown), a display device 2 and so on are furnished. Although it is not drawn in FIG. 1, a glass plane is so mounted on a front of a case 1 as to face to the display device 2. The display 2 is consisted of a minute display portion 3 of two digits for digital display of time, a hour display portion 4 of two digits, a date display portion 5 of two digits for digital display of date and a month display portion 6 for digital display of month. The case 1 is furnished with the push buttons A, B and C to operate in necessary on correcting hour, date, month and so on displayed on the display device 2.

Figure 2:
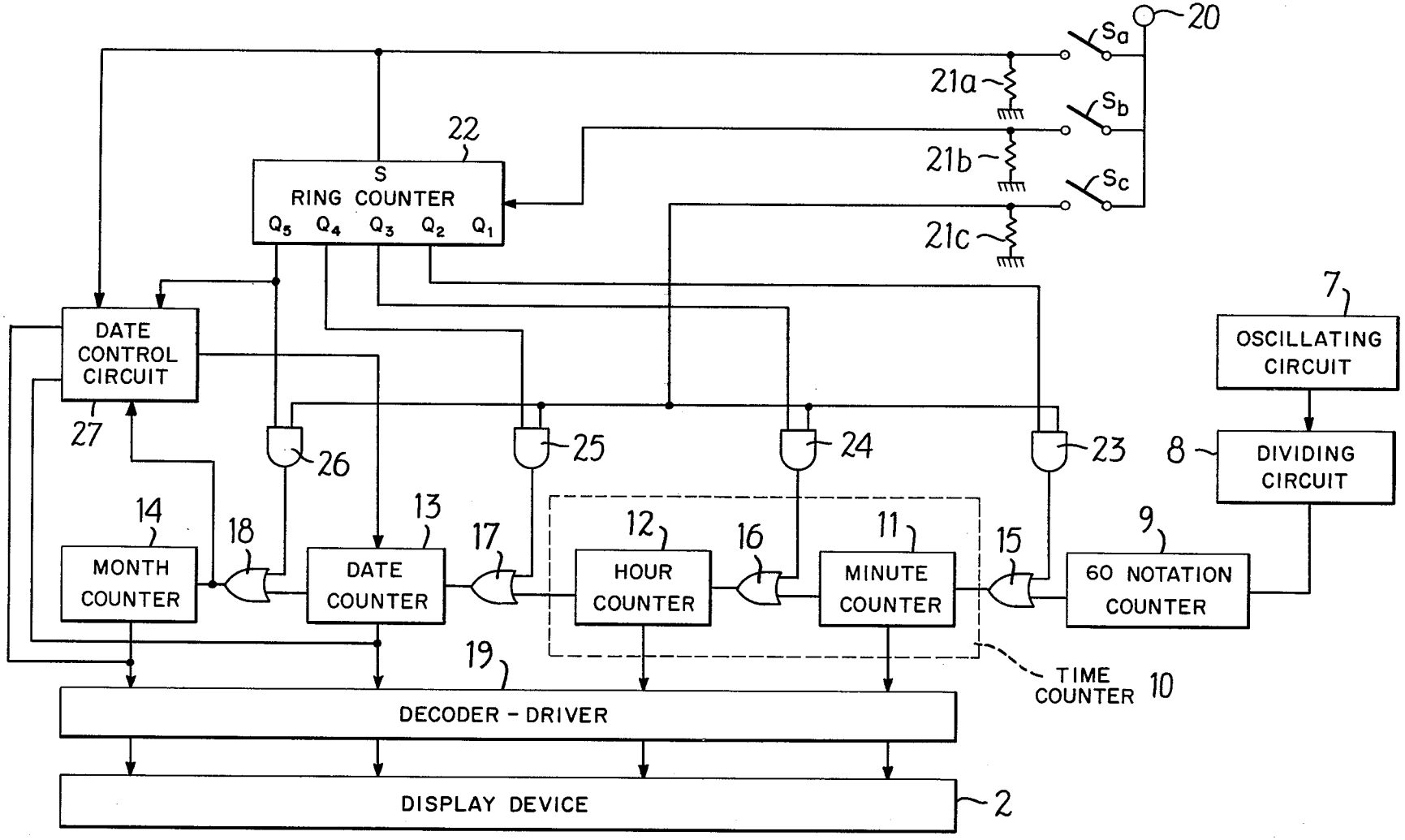
FIG. 2 shows a circuit of the embodiment.

FIG. 2 is a circuit diagram showing an embodiment of the electronic watch according to this invention, wherein 7 is an oscillating circuit which oscillates comparative high frequency standard signals of time measurement.

The oscillating circuit has a crystal oscillator. The oscillating output signal of the oscillating circuit 7 are impressed to a frequency dividing circuit 8 in order to divide the frequency to 1 second pulse of second-cycle. This 1 second pulse is supplied to a 60 notation counter 9, and is also respectively changed to 1 minute pulse. The 1 minute pulse is supplied to a minute counter 11 of a time counter 10 through an OR gate 15 having two inputs. The minute counter 11 consists of 60 notation counter, and 1 hour pulse derived from the minute counter 11 is supplied to a hour counter 12 of the time counter 10 through the OR gate having two inputs. The hour counter 12 consists of a 24 notation counter, and the date pulse derived from the hour counter 12 once per 24 hours is supplied to a date counter 13 through a OR gate 17 having two inputs. The date counter 13 consists of a 31 notation counter, and the operation of the date counter 13 is so controlled as to operate as 30, 29 and notation counters owing to a date control circuit 27 which will be explained in detail. One month pulse is output in a month from the date counter 13, and the pulse is supplied to a month counter 14 and the date control circuit 27 through a OR gate 18 having two inputs. The month counter 14 is consisted with 4 bits and 12 notation counters, and the outputs of each of the bits are supplied to the date control circuit 14.

The countings of the minute counter 11, the hour counter 12, the date counter 13 and the month counter 14 are output by a BCD code, and outputs of the countings are supplied to a decoder-driver forming the minute display portion 3, the hour display portion 4, the date display portion 5 and the month display portion 6 of the display device 2. For instance, the countings are code-converted into the segment signals corresponding to each of the segments of the display element displaying a shape of date number, and also drive each of the display elements. Therefore, the time of the countings of the time counter 10, the date of the countings of the date counter 13 and the month of the countings of the month counter 14 are individually digital-displayed on the display device 2.

S*a*, S*b* and S*c* respectively are a reset switch, a selection switch and a correction switch which are operable suitably during correcting the display of hour, date, month and so on displayed by the display device 2.

Each of the switches S*a*, S*b* and S*c* are corresponded to the push buttons A, B and C shown in FIG. 1, and become ON condition by push-in operation of the push buttons. Ordinarily those push buttons are in OFF condition. One end of the contacts of each of the switches Sa, Sb and Sc is connected to voltage supplying terminal 20 of the electronic potential corresponding to logic "1" and the other end of contacts is individually grounded to the electronic potential point corresponding to logic "0" through resistances 21a, 21b and 21c. The select switch 21b is the switch selecting the counter to be corrected when the countings of each of the counter 1, 12, 13 and 14 showed on the display device 2. And the switch outputs are input to the clock terminal CL of five notation ring counter 22.

The ring counter 22 is so adjusted as to ordinarily make Q1 output logic "1" and the other outputs logic "0." The outputs Q2, Q3, Q4 and Q5 of the ring counter 22 are individually input to one end of the input terminal of an AND gate 23, 24, 25 and 26 respectively having two inputs. The switch outputs of the correct switch Sc are input to the other input terminals of the AND gates 23, 24, 25 and 26. And the outputs of the AND gates 23, 24, 25 and 26 are individually input to said OR gates 15, 16, 17 and 18.

The switch output of the reset switch Sa is supplied to the set terminal S of the ring counter 22, and so that the ring counter 22 is so adjusted as to make the Q1 output logic "1."

Now, explanation will be continued by making a case of correcting the display of the hour display portion 4.

EXAMPLE

First, the select switch Sb is two times on-operated by the push button B and the two pulses are supplied to the ring counter 22 in order that the Q3 output becomes logic "1." Next, the correct switch Sc is ON-operated by the push-button C1 and the pulse of logic "1" is produced to the output side of the AND gate 24, which pulse is supplied to the hour counter 12 through the OR gate 16.

Consequently, the countings of the hour counter 12 change and the display of the hour display portion 4 is able to correct by selecting suitably the member of operation of the correct switch Sc. It is understandable that the same operation as the operation explained above is necessary to correct the display of the minute display portion, the date display portion 5 and the month display portion 6. After operation, when the reset switch 21a is ON-operation by the push button C, the ring counter 22 is adjusted to the condition in which the Q1 output becomes logic "1," thus in this condition, the ON-operation of the correct switch 21c brings no correction of the countings of each of the counter 11, 12, 13 and 14 because the switch outputs don't pass through the AND gates 23, 24, 25 and 26.

The switch outputs of the reset switch Sa and the correct switch Sc as well as the Q3 output of the ring counter 22, the output of the OR gate 18, the counting output of the date counter 13 and the counting output of the month counter 14 are supplied to the date control circuit 27.

The date control circuit 27 has the following functions that in the larger months of January, March, May, July, August, October, and December the date counter 13 is set to the 31 notation counter and in the shorter months of April, June, September and November, the date counter 13 is set to the 30 notation counter and that in February the date counter 13 is ordinarily set to the 28 notation counter, furthermore as is described in detail, the date control circuit 27 has the function setting the date counter 13 to the 29 notation counter in a leap year.

Figure 3:
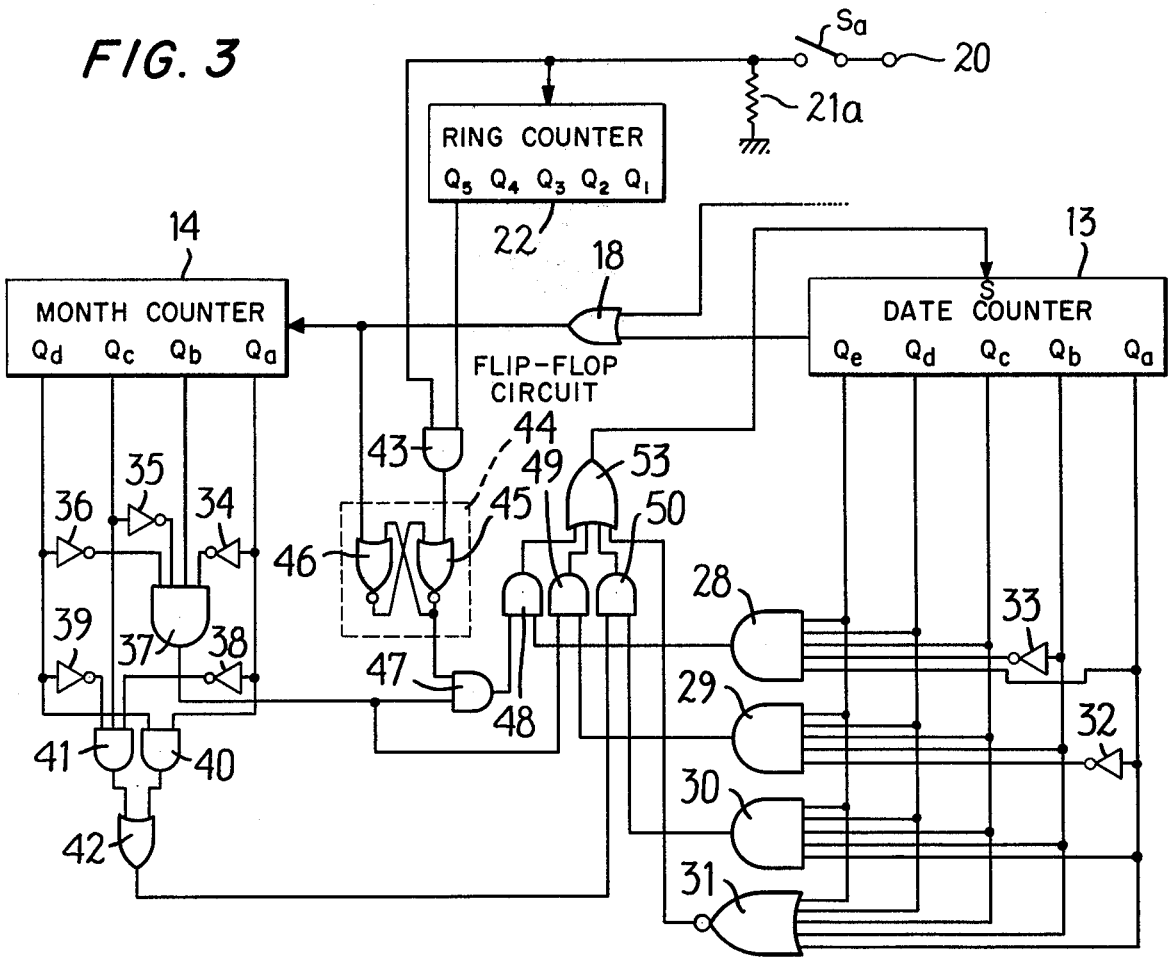
FIG. 3 is a circuit view of the embodiment of the date control shown in FIG. 2.

FIG. 3 shows an embodiment of said date control circuit 27, and in the drawing, the same marks are given to the same circuits as these shown in FIG. 2 in order to easily understand the drawing.

Qa-Qe outputs of the date counter 13 consisted of a binary counter of 5 bits are individually input to the AND gates 28, 29 and 30 of 5 inputs and to the NOR gate 31 of 5 inputs. Qa output which is input to the AND gate 29 is inverted by the inverter 32, and also Qb output which is input to the AND gate 28 is inverted by the inverter 33.

As shown in the truth table of FIG. 4, the Qe-Qa output logics of the date counter 13 become "1, 1, 1, 0, 1" when the date showing in the date display portion 5 becomes 29th day, so that the output of the AND gate 28 becomes logic "1." When the date became 30th day, the Qe—Qa output logics become "1, 1, 1, 1, 0" and when the output of the AND gate 29 becomes logic "1" and in case that the date becomes 31st day, the Qe-Qa output logics become "1, 1, 1, 1, 1" and the output of the AND gate 30 logic "1." The 31st pulse is supplied to the date counter 13 after the 31st day is passed, the Qe-Qa output logics become "0, 0, 0, 0, 0" and the output of the NOR gate 31 become logic "1."

The gate Qa, Qc and Qd outputs of the month counter 14 consisted of 4 bits binary counter are inverted by the invertor 34, 35 and 36 and are input to the AND gate 37 of 4 inputs, and also the Qb output is directly input to the AND gate 37. The Qa output of the month counter 14 is input to the AND gate 40 of 2 inputs, simultaneously, is input to the AND gate 41 of 3 inputs through the invertor 38. The Qc output is input to the AND gate 41 and the Qd output is input to the AND gate 40, simultanously, is inverted by the invertor 39 and is input to the AND gate 41. The outputs of the AND gate 40 and 41 are input to the OR gate 42 of two inputs.

The Q5 output of the ring counter 22 and the switch output of the reset switch Sa are both input to the AND gate 43. The output of the AND gate 43 are input to the NOR gate 45 of one of the NOR gates 45 and 46, which are mutually cross-connected, consisting of flip-flop circuit 44. The output of the OR gate 18 is input to the NOR gate 46. The outputs of the flip-flop circuit 44 are derived from the NOR gate 45 and are input to the AND gate 47 together with the output of said AND gate 37.

The output of the AND gate 47 is supplied to the AND gate 48 together with the output of the AND gate 28. The output of AND gate 37 is supplied to the AND gate 49 together with the output of the AND gate 29. The output of the OR gate 42 is supplied to the AND gate 50 together with the output of the AND gate 30. Each of the outputs of said AND gates 48, 49 and 50 and the NOR gate 31 are input to the OR gate 53 of four inputs. The output of the OR gate 53 is supplied to a set terminal S of the date counter 13. In reply to the output of the OR gate 53 the Qe-Qa outputs of the date counter 13 become logic "0, 0, 0, 0, 1" and the date "1" is displayed in the date display portion 5.

The Qd-Qa output logics of the month counter 14 become as shown in the truth table shown in FIG. 5. When the month of February is displayed in the month display portion 6, every inputs of the AND gate 37 become logic "1" and the outputs of the AND gate 37 become logic "1." The month shown in the month display portion 6 is April, June and November, the output of the AND gate 41 becomes logic "1." When the month shown in the month display portion 6 is September, the output of the AND gate 40 becomes logic "1." That is, in the shorter month of April, June, September and November, the output of the OR gate 42 becomes logic "1" and is input to the AND gate 50.

Since the month pulse of logic "1" is output once in a month from the OR gate 18, the outputs of the flip-flop circuit 44 are ordinarily maintained at logic "1." Therefore, when the outputs of the AND gate become logic "1" in February, the outputs of the AND gate 47 also become logic "1" and are input to the AND gate 48, simultaneously, the logic "1" outputs of the AND gate 37 are input to the AND gate 49.

In the longer month of January, March, May, July, August, October and December, the outputs of the AND 37 and the OR gate 42 are logic "0," and the countings of the date counter 11 change from 28th day to 29th day, and from 29th day to 30th day, also from 30th day to 31st day. Thus, when the signal of logic "1" is output from the AND gates 28, 29 and 30, the outputs of the AND gates, 48, 49 and 50 are maintained at logic "0." When the date displayed in the date display portion 5 is 31st day, the Q*e*–Q*a* outputs of the date counter 13 become logic "1, 1, 1, 1, 1."

When the date pulse is supplied to the date counter 13 and the outputs change to logic "0, 0, 0, 0, 0," the outputs of the NOR gate 31 become logic "1" then it is supplied to the set terminal S of the date counter 13 through the OR gate 53. Thus, in the date counter 13, the Q*e*–Q*a* outputs are adjusted to logic "0, 0, 0, 0, 1" and the display of the date of the date display portion 5 becomes "1."

Since the output of the OR gate 42 is logic "1," in a shorter month of April, June, September and November, the date changes from 30th day to 31st day and simultaneously the signal of logic "1" is output from the AND gate 30, then the signal is supplied to the set terminal S of the date counter 13 through the AND gate 50 and the OR gate 53. Thus, the display of the date display portion 5 changes from 30th day to 1st day.

Since the output of the AND gate 47 is logic "1" and also the output of the AND gate 47 is logic "1," in ordinary or short February, the date changes from 28th day to 29th day, and simultaneously the signal of logic "1" output from the AND gate 28 is supplied to the set terminal S of the date counter 13 through the AND gate 48 and the OR gate 53. Therefore, the display of the date display portion 5 changes from 28th day to 1st day.

As described above, the date circulating cycles of the date counter 13 are adjusted to 31st day at longer monthand 30th day at a shorter month except February and 28th day at February by the date control circuit 27.

In a leap year in which February is 29 days, when February is displayed in the month display portion 6, the select switch Sb is operated to correct the month to make the Q5 output of the ring counter 22 logic "1," then the reset switch S*a* is ON-operated.

By this operation, the pulse of logic "1" is output from the AND gate 43 and the flip-flop circuit 44 works reversely and the output becomes logic "0."

Consequently, the output of the AND gate 47 becomes logic "0," so that the output of the AND gate became logic "1" when the date changes from 28th day to 29th day, the output of the AND gate 48 is logic "0." When the date changes from 29th day to 30th day, the signal of logic "1" is output from the AND gate 29, and the signal is supplied to the set terminal S of the date counter 13 through the AND gate 49 and the OR gate 53. Therefore, the display of the date display portion 5 changes from 29th day to 1st day. As described above, in February, the month is selected by the select switch S*b* and the reset switch S*a* is operated in order to adjust the circulating cycle of the date of the date counter 13 to 29th day. When the month changes from February to March, by a month pulse of logic "1" output from the date counter 13 is input to the flip-flop circuit 44, the flip-flop circuit 44 is reset and the output becomes logic "1," so the circulate cycle of the date of the date counter 13 of February of next year becomes 28 days.

It is understood that by the operation of each of the switches S*a*, S*b* and S*c* on correcting the date, the circulating cycle of date of February is not adjusted to 29 days.

On the basis of the embodiment with respect to the drawing, the electronic watch of the present invention was explained in detail, however the invention is not restricted to the embodiment shown and various changes and improvement thereof can be made.

As described above, the electronic watch according to the invention has the constitution which can set the ordinarily circulating cycle of the date counter to 31st day in a longer month, 30th day in a shorter month except February and 28 days in February by the control circuit, and can changingly set the circulating cycle of the date counter of February to 29th day in a leap year by controlling the movement of the date control circuit taking advantage of the switches adapted to be used for the correction of the time, the date and so on.

As a result, it is no need of the year counter and the display portion and, furthermore, the complicated logic circuit for discriminating a leap year which are all necessary to the conventional electronic watch with the calender function. Furthermore, it is no need of special external switches for changing-over the circulating cycle of the date of February. According to the present invention, the electronic watch with useful calender function can be economically provided and purpose of the present invention was able to attain completely and the great practical effectiveness thereof will be able to be obtained.

I claim:

1. An electronic watch, comprising:

means for developing a repetitive timing signal having a repetition rate defining an interval of time;

counter means comprising a time counter, a day counter and a month counter receptive of said timing signal for counting the same and for developing counts respectively representing time of the day, day of the month, and the month, wherein said day counter includes means responsive to a control signal for limiting a maximum count of said day counter to 28, 29, 30 or 31 days according to the month;

date control means for developing said control signal and for applying the same to said day counter for limiting the maximum count of said day counter to 31 days during a long month, 30 days during a short month and 28 or 29 days during February; and display means responsive to the respective counts of said counter means for displaying time of the day, day of the month, and the month.

2. An electronic watch according to claim 1, further comprising a manually operable switch operable between an open and a closed condition for controlling an electrical switch signal; and wherein said date control means includes means responsive to said switch signal and to the count of said month counter representative of February for limiting the maximum count of said day counter to 28 or 29 days during February according to the operation of said switch.

3. An electronic watch according to claim 1, wherein said date control means is comprised of means responsive to the count of said day counter for developing output signals respectively representing when the count of said day counter corresponds to the 29th, 30th, or 31st day of the month, and after the 31st day of the month has passed; means responsive to the count of said month counter for developing output signal respectively representing when the count of said month counter corresponds to a long month, or a short month, or February; and resetting means responsive to the output signals of said means responsive to the count of said day counter and means responsive to the count of said month counter for resetting said day counter after the 31st day of a long month, after the 30th day of a short month, and after the 28th day of February.

4. An electronic watch according to claim 3, wherein said resetting means further comprises a manually operable switch operable between an open and a closed condition for developing a switch signal, and means responsive to said switch signal for resetting said day counter after the 29th day of February.

* * * * *